US011128047B2

(12) United States Patent
Xue et al.

(10) Patent No.: US 11,128,047 B2
(45) Date of Patent: Sep. 21, 2021

(54) MOBILE TERMINAL AND ANTENNA OF MOBILE TERMINAL

(71) Applicant: Huawei Technologies Co., Ltd., Shenzhen (CN)

(72) Inventors: Liang Xue, Shanghai (CN); Pengfei Wu, Shanghai (CN); Laiwei Shen, Shanghai (CN); Zhiyuan Xie, Shanghai (CN); Jiaqing You, Shanghai (CN); Dong Yu, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 36 days.

(21) Appl. No.: 16/637,185

(22) PCT Filed: Nov. 10, 2017

(86) PCT No.: PCT/CN2017/110440
§ 371 (c)(1),
(2) Date: Feb. 6, 2020

(87) PCT Pub. No.: WO2019/090690
PCT Pub. Date: May 16, 2019

(65) Prior Publication Data

US 2020/0373669 A1 Nov. 26, 2020

(51) Int. Cl.
*H01Q 1/48* (2006.01)
*H01Q 5/35* (2015.01)
(Continued)

(52) U.S. Cl.
CPC ..... *H01Q 5/35* (2015.01); *H01Q 1/243* (2013.01); *H01Q 1/52* (2013.01); *H01Q 5/328* (2015.01); *H01Q 5/335* (2015.01); *H01Q 13/10* (2013.01)

(58) Field of Classification Search
CPC ..... H01Q 5/35; H01Q 5/328; H01Q 1/243; H01Q 1/52; H01Q 5/335; H01Q 13/10
See application file for complete search history.

(56) References Cited

U.S. PATENT DOCUMENTS 9,276,319 B2 3/2016 Vazquez et al.
9,444,130 B2 9/2016 Bevelacqua et al.
(Continued)

FOREIGN PATENT DOCUMENTS

CN 104103888 A 10/2014
CN 205081230 U 3/2016
(Continued)

*Primary Examiner* — Joseph J Lauture
(74) *Attorney, Agent, or Firm* — Conley Rose, P.C.

(57) ABSTRACT

An antenna includes a radiator, where the radiator includes three parts separated by a gap, an end of a second part proximate to a first part is a first end, and an end of the second part proximate to a third part is a second end, a medium-high frequency feeder, electrically coupled to the radiator at a first coupling point, a low frequency feeder electrically coupled to the radiator, a first ground cable electrically coupled to the radiator at a second coupling point, where an adjustable component for controlling conduction of the first ground cable is disposed on the first ground cable, a length from the second coupling point to an end that is in the first end and the second end and that is further from the first coupling point is a quarter of a wavelength corresponding to a resonance frequency.

20 Claims, 6 Drawing Sheets

(51) Int. Cl.

| | |
|---|---|
| ***H01Q 5/328*** | (2015.01) |
| ***H01Q 1/24*** | (2006.01) |
| ***H01Q 1/52*** | (2006.01) |
| *H01Q 5/335* | (2015.01) |
| *H01Q 13/10* | (2006.01) |

(56) References Cited

U.S. PATENT DOCUMENTS

| | | | | |
|---|---|---|---|---|
| 2017/0033437 | A1 | 2/2017 | Ghit et al. | |
| 2017/0162933 | A1 | 6/2017 | Xiong et al. | |
| 2018/0026355 | A1* | 1/2018 | Lee ..... | H01Q 5/335 343/770 |

FOREIGN PATENT DOCUMENTS

| | | | |
|---|---|---|---|
| CN | 105789831 | A | 7/2016 |
| CN | 106058436 | A | 10/2016 |
| CN | 106848567 | A | 6/2017 |
| CN | 206532881 | U | 9/2017 |
| CN | 107240760 | A | 10/2017 |
| CN | 107331964 | A | 11/2017 |

* cited by examiner

MOBILE TERMINAL AND ANTENNA OF MOBILE TERMINAL

CROSS-REFERENCE TO RELATED APPLICATIONS

This application is a U.S. National Stage of International Patent Application No. PCT/CN2017/110440 filed on Nov. 10, 2017, which is hereby incorporated by reference in its entirety.

TECHNICAL FIELD

This application relates to the field of communications technologies, and in particular, to a mobile terminal and an antenna of a mobile terminal.

BACKGROUND

Currently, in a design of a mobile phone antenna, a requirement for multi-band carrier aggregation (carrier aggregation, CA) performance is increasing. In a conventional single antenna design, because a low frequency control unit is coupled to a medium-high frequency control unit, a medium-high resonance frequency offset may be caused during low frequency switching, resulting in deterioration of medium-high frequency performance during CA of low frequency and medium-high frequency.

An existing solution is as follows: A low frequency signal and a medium-high frequency signal are separately fed, to split and decouple the low frequency signal and the medium-high frequency signal. FIG. 1 is a schematic structural diagram of an antenna in which a low frequency signal and a medium-high frequency signal are separately fed in the prior art. A low frequency feeder 1 is connected to a metal frame 5, and a matching network 6 is disposed on the low frequency feeder 1. The metal frame 5 is connected to a ground cable by using a switch 3, and the switch 3 is used for high frequency switching. A medium-high frequency feeder 2 is connected to another metal frame 4, and a matching network 7 is disposed on the medium-high frequency feeder 2.

In the foregoing technical solution, a low frequency and a medium-high frequency are split, and space in which a single antenna is originally disposed is divided for two antennas. Therefore, space for each antenna becomes smaller, and particularly, a medium-high frequency antenna is compressed within a small region in a lower right corner, resulting in poor antenna performance.

FIG. 2 shows a simulation analysis based on the foregoing technical solution. The medium-high frequency antenna excites only two resonance modes: a resonance 1 and a resonance 2. The switch 3 is switched over, and a resonance excited by the medium-high frequency antenna may be changed. When the switch 3 is not switched over, the antenna excites the resonance 1 and the resonance 2. When the switch 3 is switched over, the resonance 1 moves from a solid line position to a dashed line position. That is, before and after the switch 3 is switched over, a quantity of resonances excited by the medium-high frequency antenna remains unchanged, and only a position of a resonance frequency changes.

In the technical solution, if a clearance is large, a full frequency (frequencies from 1.7 GHz to 2.7 GHz) of a medium-high frequency band can be barely covered. However, as the clearance decreases, a bandwidth of the medium-high frequency antenna severely deteriorates, and not all frequencies of the medium-high frequency band can be covered. In addition, subsequently, new frequency bands B21 (1.5 GHz) and B42 (3.5 GHz) need to be covered, and the foregoing technical solution cannot meet the requirement.

SUMMARY

This application provides an antenna of a mobile terminal, to increase a frequency band of the antenna and improve a communication effect of the antenna.

This application provides an antenna of a mobile terminal. The antenna includes: a radiator, where the radiator includes a first part, a second part, and a third part that are separated from each other by gaps, the first part and the third part are respectively disposed on two sides of the second part, an end, of the second part, close to the first part is a first end, and an end, of the second part, close to the third part is a second end;

- a medium-high frequency feeder, electrically connected to the radiator at a first connection point;
- a low frequency feeder, electrically connected to the radiator; and
- a first ground cable, electrically connected to the radiator at a second connection point, where an adjustable component for controlling conduction of the first ground cable is disposed on the first ground cable;
- when the adjustable component is not conducted, the antenna works at least on a first resonance frequency, and does not work on a second resonance frequency;
- when the adjustable component is conducted, the antenna works at least on the first resonance frequency and on the second resonance frequency; and
- a length, to the second connection point, from an end that is in the first end and the second end and that is further from the first connection point is a quarter of a wavelength corresponding to the second resonance frequency.

In the foregoing implementation solution, the first ground cable is added, and the adjustable component is disposed on the first ground cable to adjust a conduction status of the first ground cable. When the ground cable is conducted, the medium-high frequency feeder excites an original resonance, and further excites a new resonance by using a low frequency radiator corresponding to the low frequency feeder, so that a bandwidth of a medium-high frequency is increased, thereby improving antenna performance.

In a specific implementation solution, the first resonance frequency is from 700 megahertz to 960 megahertz, and the second resonance frequency is from 1700 megahertz to 2700 megahertz.

In a specific implementation solution, the antenna further works on a third resonance frequency when the adjustable component is not conducted, and the third resonance frequency is from 1700 megahertz to 2700 megahertz, and the third resonance frequency is not equal to the second resonance frequency.

In a specific implementation solution, the first connection point is located at the second part of the radiator. The first connection point may be provided at a different position of the radiator.

In a specific implementation solution, the first connection point is located at the third part of the radiator. The first connection point may be provided at a different position of the radiator.

In a specific implementation solution, the low frequency feeder is connected to the radiator at a third connection point, and a length from the third connection point to the first end is greater than a length from the first connection point to the first end.

In a specific implementation solution, the antenna further includes a second ground cable. The second ground cable is electrically connected to the second part. The low frequency feeder is electrically connected to the first end by using a bent conductive wire. The low frequency feeder, the conductive wire, the second part, and the second ground cable form a loop, and form a loop antenna.

In a specific implementation solution, the conductive wire is a printed circuit board, a flexible circuit board, or a metal wire. That is, a conductive wire may be formed by using different structures, provided that an electrical connection between a second frame and the low frequency feeder can be implemented.

In a specific implementation solution, the adjustable component may be different components, provided that the conduction status of the first ground cable can be controlled. Specifically, the adjustable component is a switch, a low-cut high-pass filter, or an adjustable capacitor.

In a specific implementation solution, a low frequency signal isolator is disposed on the medium-high frequency feeder, and a high frequency signal isolator is disposed on the low frequency feeder. Therefore, the medium-high frequency feeder can be prevented from affecting a low frequency signal, and the low frequency feeder can be prevented from affecting a medium-high frequency signal, thereby improving communication performance of the antenna.

In a specific implementation solution, the second connection point is located on one side of a USB port of the mobile terminal, and the first connection point is located on the other side of the USB port. This facilitates disposing of the components.

In a specific implementation solution, the first part, the second part, and the third part use a metal frame of the mobile terminal.

According to a second aspect, a mobile terminal is provided, and the mobile terminal includes the antenna according to any implementation of the first aspect.

In the foregoing implementation solution, the first ground cable is added, and the adjustable component is disposed on the first ground cable to adjust the conduction status of the first ground cable. When the first ground cable is conducted, the medium-high frequency feeder excites an original resonance, and further excites a new resonance by using the low frequency radiator corresponding to the low frequency feeder, so that a frequency of medium-high frequency is increased, thereby improving antenna performance.

DESCRIPTION OF EMBODIMENTS

To make the objectives, technical solutions, and advantages of this application clearer, the following further describes this application in detail with reference to the accompanying drawings.

Figure 1:
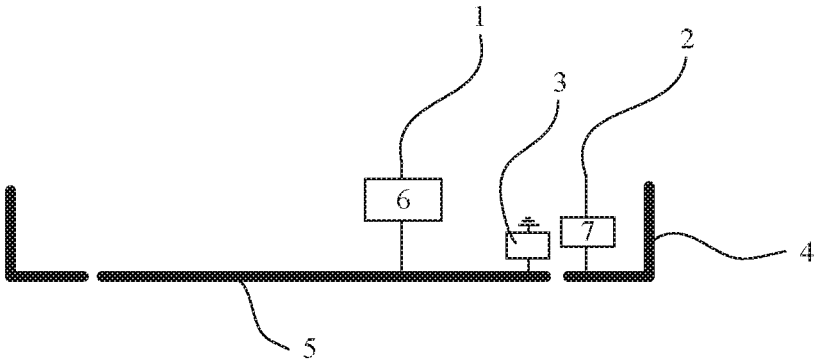
FIG. 1 is a schematic structural diagram of an antenna in which a low frequency signal and a medium-high frequency signal are separately fed in the prior art.
Figure 2:
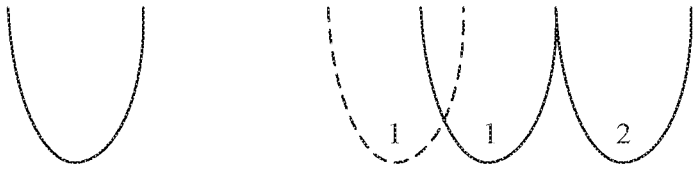
FIG. 2 is a schematic diagram of resonances excited by an antenna of a mobile terminal in the prior art.
Figure 3:
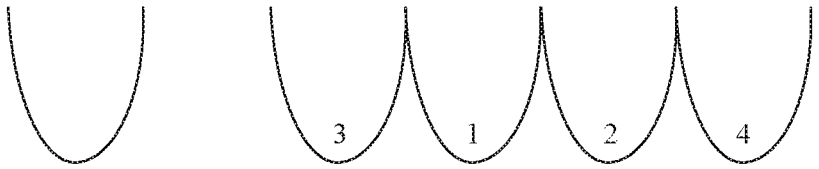
FIG. 3 is a schematic diagram of resonances excited by an antenna according to an embodiment of this application.

To excite a new resonance mode, embodiments of the present invention provide an antenna of a mobile terminal. The antenna includes a radiator and a feeding unit. The radiator includes a first part, a second part, and a third part that are separated from each other by gaps. The first part and the third part are separately disposed on two sides of the second part. To facilitate description, two ends of the second part are defined: an end, of the second part, close to the first part is a first end, and an end, of the second part, close to the third part is a second end. The feeding unit includes two feeders: a low frequency feeder and a medium-high frequency feeder. The low frequency feeder and the medium-high frequency feeder are separately electrically connected to the radiator. The electrical connection means that the two components may be conductively connected, the low frequency feeder and a part of the radiator form a low frequency antenna, and the medium-high frequency feeder and another part of the radiator form a medium-high frequency antenna. Optionally, a frequency band of a low frequency is from 700 megahertz to 960 megahertz, a frequency band of a medium frequency is from 1700 megahertz to 2200 megahertz, and a frequency band of a high frequency is from 2300 megahertz to 2700 megahertz. FIG. 3 shows resonances excited by a medium-high frequency antenna in an embodiment of the present invention. Compared with the prior art, the medium-high frequency antenna provided in this embodiment of this application can excite more new resonances. Both a resonance 3 and a resonance 4 shown in FIG. 3 are newly excited resonances.

Figure 4:
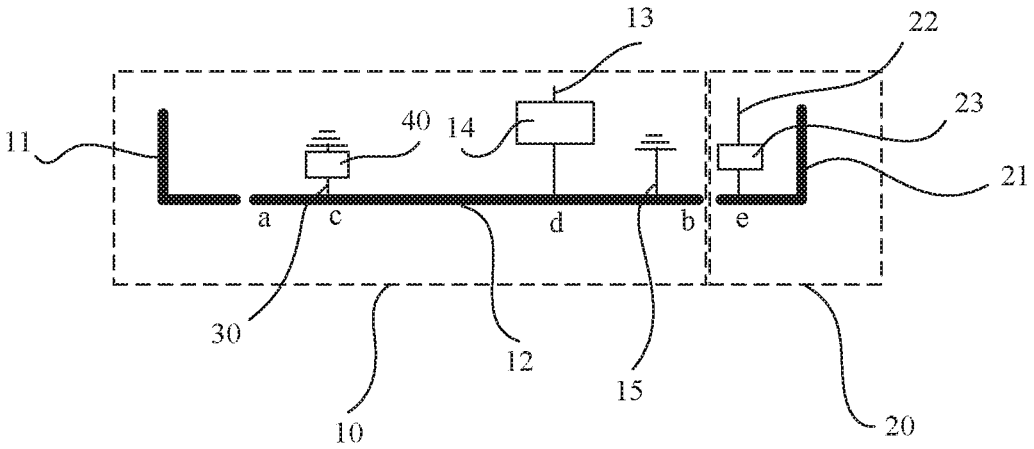
FIG. 4 is a schematic structural diagram of an antenna of a mobile terminal according to an embodiment of this application.

FIG. 4 is a schematic structural diagram of an antenna of a mobile terminal according to an embodiment of this application. The figure shows only a part of the mobile terminal. In this embodiment of this application, the mobile terminal uses a metal frame, and the metal frame is used as a part of a radiator of the antenna provided in this embodiment of this application. The metal frame includes three parts separated from each other by gaps: a first frame 11, a second frame 12, and a third frame 21. The first frame 11, the second frame 12, and the third frame 21 respectively correspond to a first part, a second part, and a third part of the radiator.

Figure 5:
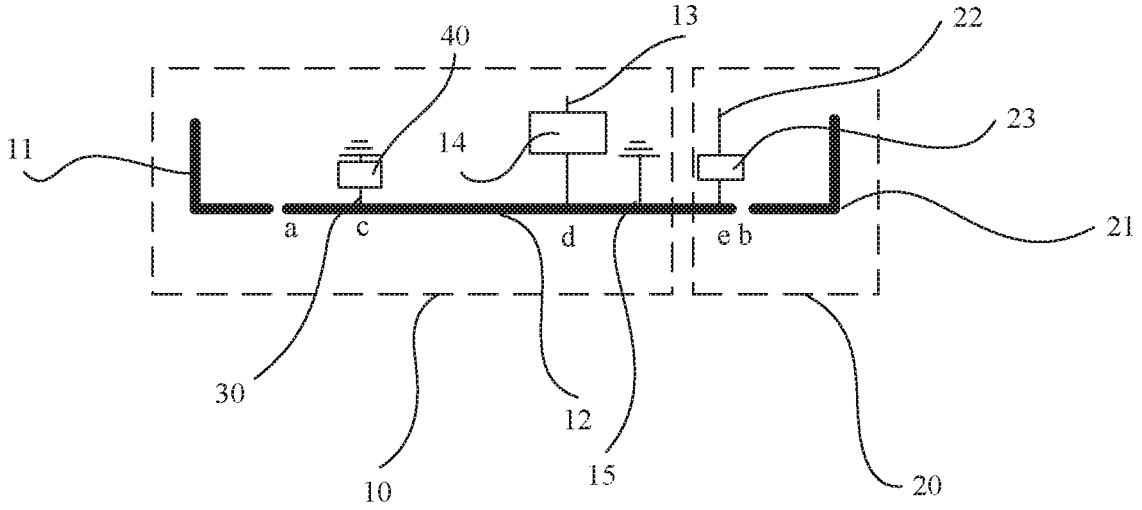
FIG. 5 is a schematic structural diagram of an antenna of a mobile terminal according to another embodiment of this application.

During specific connection, a medium-high frequency feeder 22 is electrically connected to the radiator at a first connection point e, a low frequency feeder 13 is electrically connected to the radiator, and the low frequency feeder 13 is connected to the radiator at a third connection point d. In an embodiment shown in FIG. 4, the low frequency feeder 13 is electrically connected to the second frame 12, and the medium-high frequency feeder 22 is electrically connected to the third frame 21. In this case, the first connection point e is located on the third frame 21, and the third connection point d is located on the second frame 12. A low frequency antenna 10 (a dashed line in the figure facilitates indication, and does not actually exist, the same below) includes the low frequency feeder 13 and a low frequency radiator. The low frequency radiator includes the second frame 12 electrically connected to the low frequency feeder 13, and further includes the first frame 11. A medium-high frequency antenna 20 (a dashed line in the figure facilitates indication, and does not actually exist, the same below) includes a medium-high frequency feeder 22 and a medium-high frequency radiator. The medium-high frequency radiator includes the third frame 21 electrically connected to the medium-high frequency feeder 22. In another embodiment, as shown in FIG. 5, the medium-high frequency feeder 22 is electrically connected to the second frame 12. In this case, the first connection point e is located on the second frame 21, and the third connection point d is located on the second frame 12. The low frequency antenna 10 includes the low frequency feeder 13 and the low frequency radiator. The low frequency radiator includes a left part of the second frame 12 and the first frame 11. The left part of the second frame 12 is a part of the second frame 12 and is close to a gap between the first frame 11 and the second frame 12, namely, a part of the second frame 12 enclosed by a dashed-line box shown in FIG. 5. The medium-high frequency antenna 20 includes the medium-high frequency feeder 22 and the medium-high frequency radiator. The medium-high frequency radiator includes a right part of the second frame 12 and the third frame 21, namely, the second frame 12 and the third frame 21 enclosed by a dashed-line box in FIG. 5.

In addition, the antenna further includes a first ground cable 30 electrically connected to the radiator. When the radiator is the foregoing metal frame, the first ground cable 30 is electrically connected to the second frame 12 at a second connection point c. In addition, an adjustable device 40 for controlling conduction of the first ground cable 30 is disposed on the first ground cable 30.

During specific disposition, a length, to the second connection point c, from an end that is in a first end a and a second end b and that is further from the first connection point e is a quarter of a wavelength corresponding to a second resonance frequency. The second resonance frequency is a resonance frequency newly generated in a frequency band that meets a requirement according to a design. The resonance frequency is specified according to an actual requirement, and a resonance that needs to be excited is a medium-high frequency resonance. In addition, it should be understood that, because of differences in base board materials, antenna materials, and the like, a length from the connection point on the radiator to a connection point that is on the radiator and is away from a connection point of a high frequency feeder and the radiator is fluctuated. Therefore, a length of a quarter of a wavelength corresponding to the resonance frequency that needs to be excited also fluctuates within a specific range, provided that a required frequency can be excited. In other words, meanings of "is" herein and "approximately equal to" are similar. In addition, the "length" herein may be understood as a consistent meaning expressed by "electrical length".

Still referring to FIG. 4, the first ground cable 30 is disposed on the second frame 12. When the first ground cable 30 is conducted, in other words, when the adjustable component 40 is in a conducted state, the second frame 12 is grounded by using the first ground cable 30, and the medium-high frequency feeder 22 uses a low frequency radiator (the second frame 12) to excite a new resonance. The newly excited resonance is the resonance that needs to be excited. In addition, when the new resonance is excited, an originally excited resonance still exists. Therefore, compared with an antenna in the prior art, a bandwidth of a frequency band of the medium-high frequency antenna 20 can be increased, to improve performance of the antenna.

To describe in detail a specific structure and principle of the antenna provided in this embodiment, the following describes in detail the structure and principle with reference to specific accompanying drawings and embodiments. To facilitate description, in FIG. 4 to FIG. 9, FIG. 11 to FIG. 14, FIG. 16, and FIG. 17, an end that is on the second frame 12 and adjacent to the first frame 11 is the first end a; an end that is on the second frame 12 and adjacent to the third frame 21 is the second end b; the second connection point at which the first ground cable 30 is connected to the second frame 12 is marked as c; and the third connection point at which the low frequency feeder 13 is connected to the second frame 12 is marked as d. In addition, when the medium-high frequency feeder 22 is connected to the second frame 12, the first connection point at which the medium-high frequency feeder 22 is connected to the second frame 12 or the third frame 21 is marked as e.

Still referring to FIG. 4, the antenna provided in this embodiment includes two parts: the low frequency antenna 10 and the medium-high frequency antenna 20. The low frequency antenna 10 further includes a second ground cable 15. The second ground cable 15 and the low frequency feeder 13 are separately connected to the second frame 12, and the low frequency antenna 10 forms an inverted-F shape. The low frequency feeder 13 and the second ground cable 15 may be connected to the second frame 12 by using a spring. This may be determined according to an actual situation during specific disposition. In specific application, the low frequency feeder 13 excites a signal in a low frequency band by using the low frequency radiator (the first frame 11 and the second frame 12), for example, the low frequency band is from 700 megahertz to 960 megahertz.

The medium-high frequency antenna 20 in this embodiment includes two different states. When the first ground cable 30 is not conducted, in other words, when the adjustable component 40 is in a non-conducted state, a resonance generated by the medium-high frequency antenna 20 is the same as a resonance generated in the prior art. Details are not described herein. When the first ground cable 30 is conducted, in other words, when the adjustable component 40 is in a conducted state, the second frame 12 is grounded by using the first ground cable 30. In this case, the medium-high frequency feeder 22 may generate a new resonance by using the second frame 12, for example, the new resonance falls within a range from 1700 megahertz to 2700 megahertz.

In actual application, both the medium-high frequency antenna 20 and the low frequency antenna 10 usually need to be used. To avoid signal interference between the two antennas, referring to FIG. 4, in a specific implementation solution, a low frequency signal isolator 23 is disposed on the medium-high frequency feeder 22, and a high frequency signal isolator 14 is disposed on the low frequency feeder 13. In application, the low frequency signal isolator 23 may block a low frequency signal, and the high frequency signal isolator 14 may block a high frequency signal. Therefore, a signal of the low frequency antenna 10 cannot be transmitted on the medium-high frequency feeder 22, and a signal of the medium-high frequency antenna 20 cannot be transmitted on the low frequency feeder 13 either, thus avoiding crosstalk between the two antennas and improving antenna communication performance.

Referring to FIG. 5, both the medium-high frequency feeder 22 and the low frequency feeder 13 are electrically connected to the second frame 12. In this solution, the medium-high frequency antenna 20 may also excite a new resonance when the second ground cable 15 is conducted. In this case, resonances excited by the medium-high frequency antenna include a newly excited resonance and an original resonance. Compared with a medium-high frequency antenna in the prior art, a bandwidth of the medium-high frequency antenna 20 is increased.

To facilitate understanding of a resonance newly excited by the medium-high frequency antenna 20 provided in this embodiment, simulation is performed by using an antenna structure shown in FIG. 5. The resonances excited by the medium-high frequency antenna 20 provided in this embodiment include a resonance 1, a resonance 2, a resonance 3, and a resonance 4 shown in FIG. 3. The resonance 1 and the resonance 2 are original resonances and are not described herein, and the resonance 3 and the resonance 4 are newly excited resonances. It should be noted that, a position relationship between the resonances 1 to 4 in FIG. 3 is an example. The newly generated resonance 3 may also be higher than the resonance 1, and the newly generated resonance 4 may also be lower than the resonance 2. This is not limited herein.

Figure 6:
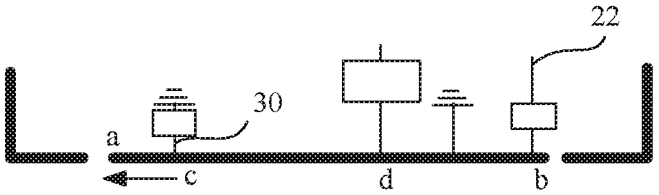
FIG. 6 is a schematic diagram of a current for exciting a resonance 1 by a medium-high frequency antenna shown in FIG. 5.
Figure 7:
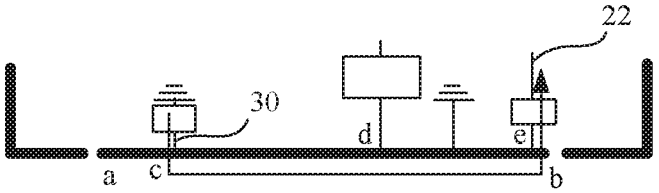
FIG. 7 is a schematic diagram of a current for exciting a resonance 3 by a medium-high frequency antenna shown in FIG. 5.

FIG. 6 shows a direction of a current on the second frame 12 when the resonance 1 is excited. It can be seen from FIG. 6 that, the medium-high frequency antenna 20 excites the resonance 3 by using a part from the second connection point c of the first ground cable 30 on the second frame 12 to the first end a of the second frame 12. For the resonance 4, it can be seen from FIG. 7 that, the medium-high frequency antenna 20 excites the resonance 4 by using a part from the second connection point c of the first ground cable 30 on the second frame 12 to the first connection point e of the medium-high frequency feeder 22. It can be seen from FIG. 6 and FIG. 7 that, in the antenna provided in this embodiment, the medium-high frequency antenna 20 may excite new resonances (the resonance 3 and the resonance 4) by using the low frequency radiator of the low frequency antenna 10, so that a bandwidth of the medium-high frequency antenna 20 can be effectively increased, thereby improving performance of the antenna. In this way, the antenna can still achieve a good communication effect in a relatively small clearance.

In this embodiment of the present invention, a length, to the second connection point c, from an end that is in the first end a and the second end b and that is further from the first connection point e is a quarter of the wavelength corresponding to the second resonance frequency. Specifically, as shown in FIG. 5, a distance from the second connection point c of the first ground cable 30 and the second frame 12 to the first end a of the second frame 12 is a quarter of the wavelength corresponding to the second resonance frequency. The second resonance frequency is a frequency of the foregoing resonance 3.

In addition to a requirement for the distance from the second connection point c of the first ground cable 30 and the second frame 12 to the first end a of the second frame 12, the first ground cable 30 further meets the following requirements. A distance from the second connection point c of the first ground cable 30 and the second frame 12 to the connection point of the medium-high frequency feeder 22 and the second frame 12 or the third frame 21 is no less than a specified distance. In this way, it is ensured that there is a sufficient interval between the first connection point e of the medium-high frequency feeder 22 and the second frame 12 or the third frame 21, and the second connection point c of the first ground cable 30 and the second frame 12, to excite a new resonance. In a specific implementation solution, the specified distance is 25 mm. For example, the distance from the second connection point c of the first ground cable 30 and the second frame 12 to the first connection point e of the medium-high frequency feeder 22 and the second frame 12 or the third frame 21 is any distance that is not less than 25 mm, for example, 25 mm, 26 mm, 27.2 mm, 28.7 mm, or 30.55 mm.

In addition, the second connection point c of the first ground cable 30 and the second frame 12 further meets the following requirements. The second connection point c of the first ground cable 30 and the second frame 12 is located on one side of a USB port of the mobile terminal, and the first connection point e of the medium-high frequency feeder 22 and the second frame 12 or the third frame 21 is located on the other side of the USB port. Therefore, space in the mobile terminal can be used properly.

Figure 8:
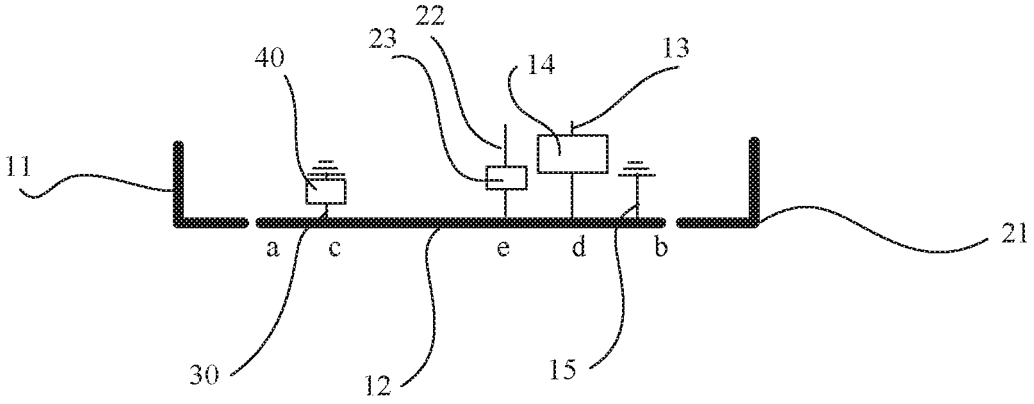
FIG. 8 is a schematic structural diagram of an antenna of a mobile terminal according to another embodiment of this application.

To improve a communication effect of the low frequency antenna 10, as shown in FIG. 8, a length from the third connection point d of the low frequency feeder 13 and the second frame 12 to the first end a of the second frame 12 is greater than a distance from the first connection point e of the medium-high frequency feeder 22 and the second frame 12 to the first end a of the second frame 12. Referring to FIG. 4 and FIG. 8, in the antenna structure shown in FIG. 4, because the medium-high frequency feeder 22 is located on the right of the low frequency feeder 13 (an antenna placement direction shown in FIG. 4 is a reference direction). Therefore, when the low frequency feeder 13 is disposed, space needs to be reserved for the medium-high frequency feeder 22. However, in a manner shown in FIG. 8, because the medium-high frequency feeder 22 is disposed on the left of the low frequency feeder 13 (an antenna placement direction shown in FIG. 8 is a reference direction), the low frequency feeder 13 may be disposed closer to the second end b of the second frame 12. Therefore, a length of the low frequency radiator of the low frequency antenna 10 can be effectively increased, thereby improving the communication effect of the low frequency antenna 10.

In the foregoing embodiment, a radiation frequency of the antenna is changed by controlling the adjustable component 40. When the adjustable component is not conducted, the antenna works at least on a first resonance frequency, and does not work on the second resonance frequency. When the adjustable component is conducted, the antenna works at least on the first resonance frequency and the second resonance frequency. In addition, when the adjustable component is not conducted, the antenna further works on a third resonance frequency. The first resonance frequency is a low frequency and is from 700 megahertz to 960 megahertz, the second resonance frequency is from 1700 megahertz to 2700 megahertz, and the third resonance frequency is from 1700 megahertz to 2700 megahertz. The second resonance frequency is a medium-high frequency resonance frequency newly generated after the adjustable component is conducted, and a frequency of the second resonance frequency is different from the existing third resonance frequency when the adjustable component is not conducted. In an example of FIG. 3, the second resonance frequency and the third resonance frequency are frequencies corresponding to the resonance 3 and the resonance 4 in FIG. 3.

During specific disposition, the adjustable component 40 may be different components, including a switch, a low-cut high-pass filter, or an adjustable capacitor. When the adjustable component 40 is a switch, the switch may be a single-pole switch or another common switch in the prior art. When the switch is in a non-conducted state, and the first ground cable 30 is not conducted, the medium-high frequency antenna 20 can generate only the resonance 1 and the resonance 2 shown in FIG. 3. When the switch is in a conducted state, and the first ground cable 30 is conducted, the medium-high frequency antenna 20 may generate the resonance 1, the resonance 2, the resonance 3, and the resonance 4, where the resonance 3 and the resonance 4 are newly excited resonances. When the antenna is a low-cut high-pass filter, the low-cut high-pass filter can block a low frequency signal. To be specific, when a low frequency signal passes, it is equivalent that the first ground cable 30 is not conducted; however, when a high frequency signal passes, it is equivalent that the first ground cable 30 is conducted. In this case, a signal on the medium-high frequency antenna 20 may be transmitted on the first ground cable 30. The resonance 1, the resonance 2, the resonance 3, and the resonance 4 may be excited, to increase the bandwidth of the medium-high frequency antenna 20. When the adjustable component 40 is an adjustable capacitor, a size of a conductive signal may be adjusted based on a capacitance value, to excite a new resonance.

Figure 9:
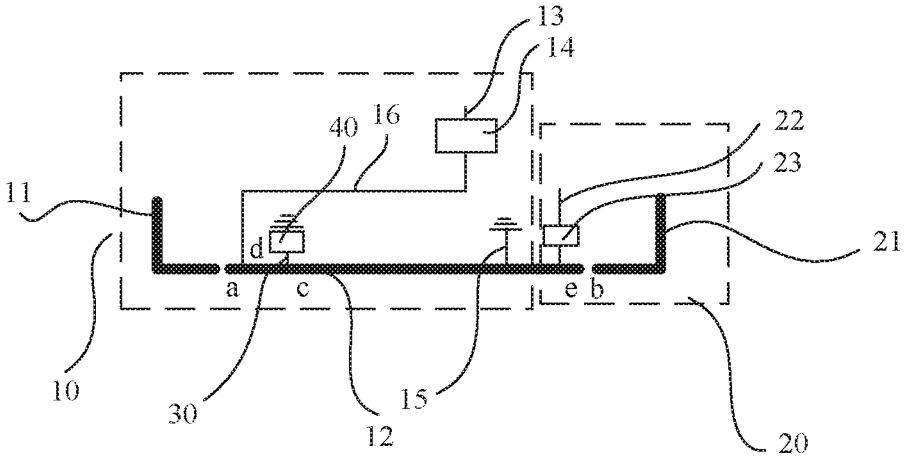
FIG. 9 is a schematic structural diagram of an antenna of a mobile terminal according to another embodiment of this application.
Figure 14:
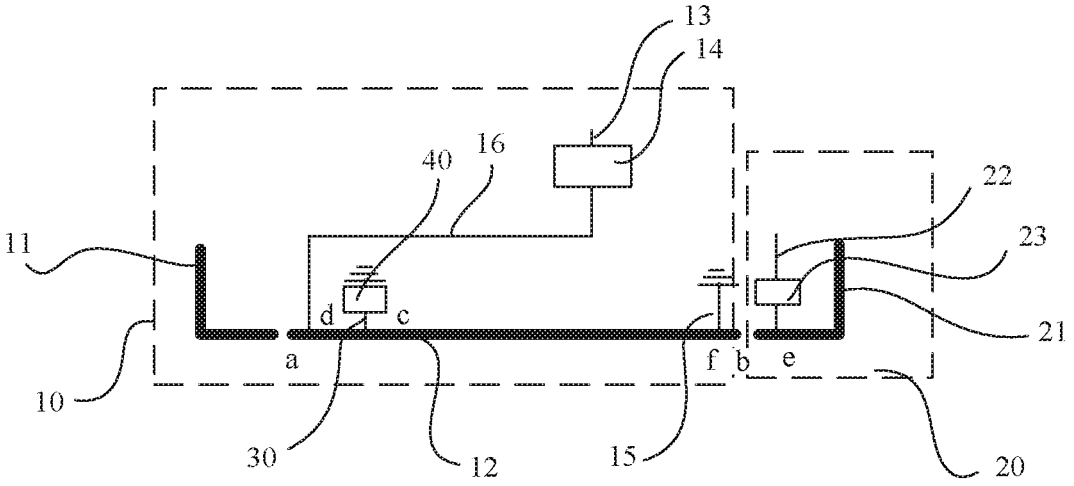
FIG. 14 is a schematic structural diagram of an antenna of a mobile terminal according to another embodiment of this application.

As shown in FIG. 9 and FIG. 14, the low frequency antenna 10 provided in this embodiment is a loop antenna. A difference between structures of the medium-high frequency antenna 20 shown in FIG. 9 and FIG. 14 lies in a difference between disposition positions of the medium-high frequency feeder 22. The following describes a structure of the antenna in detail with reference to FIG. 9 and FIG. 14.

First, referring to FIG. 9, the radiator also uses a metal frame. The low frequency antenna 10 provided in this embodiment includes the first ground cable 30, the second ground cable 15, the low frequency feeder 13, and a bent conductive wire 16. The second ground cable 15 is electrically connected to the second frame 12. The low frequency feeder 13 is electrically connected to the first end a of the second frame 12 by using the conductive wire 16. The low frequency feeder 13, the conductive wire 16, the second frame 12, and the second ground cable 15 form a loop. The conductive wire 16 may be partially disposed on a printed circuit board, a flexible circuit board, a metal wire, or the like, provided that the second frame 12 can be electrically connected to the low frequency feeder 13.

In this embodiment, a structure of the medium-high frequency feeder 22 of the medium-high frequency antenna 20 is the same as the structure shown in FIG. 5. To be specific, the medium-high frequency feeder 22 is also disposed on the second frame 12. For functions and structures of the first ground cable 30 and the adjustable component 40, refer to the foregoing embodiments. Details are not described herein again.

Figure 10:
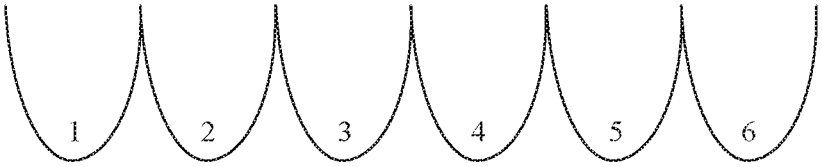
FIG. 10 is a schematic diagram of resonances excited by an antenna shown in FIG. 9.
Figure 11:
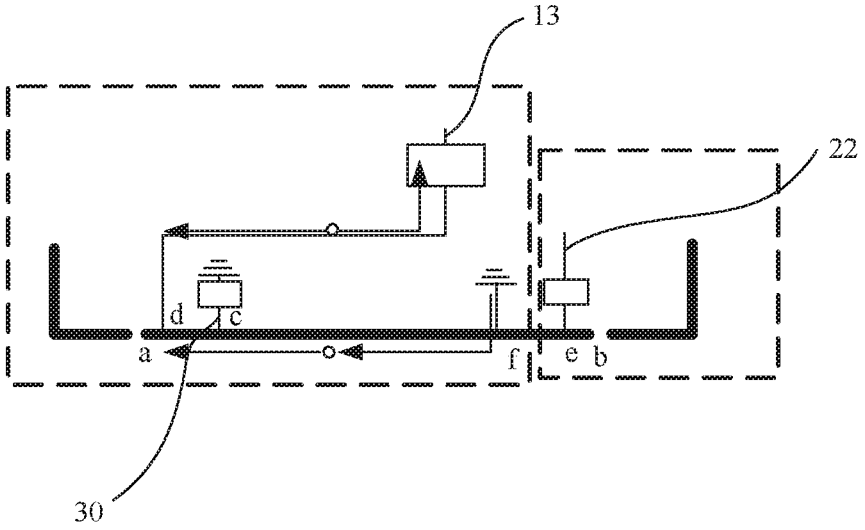
FIG. 11 is a schematic current diagram of a resonance 1 excited by a medium-high frequency antenna shown in FIG. 9.
Figure 12:
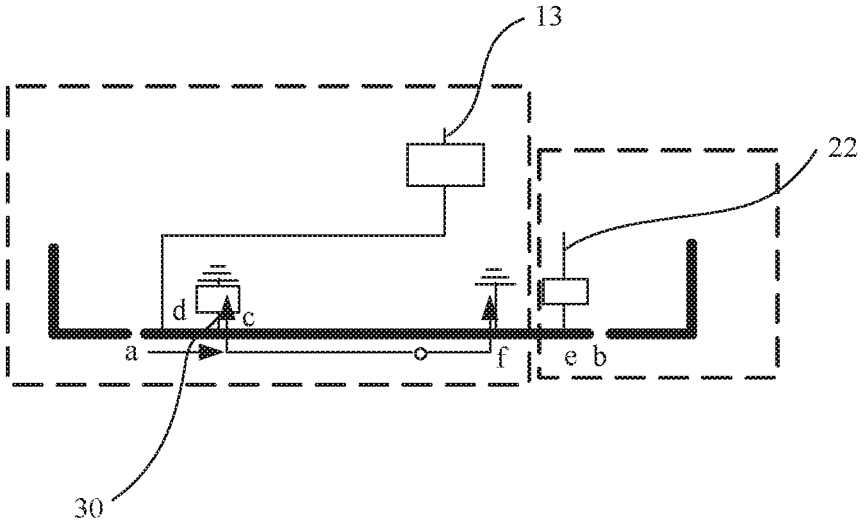
FIG. 12 is a schematic current diagram of a resonance 2 excited by a medium-high frequency antenna shown in FIG. 9.
Figure 13:
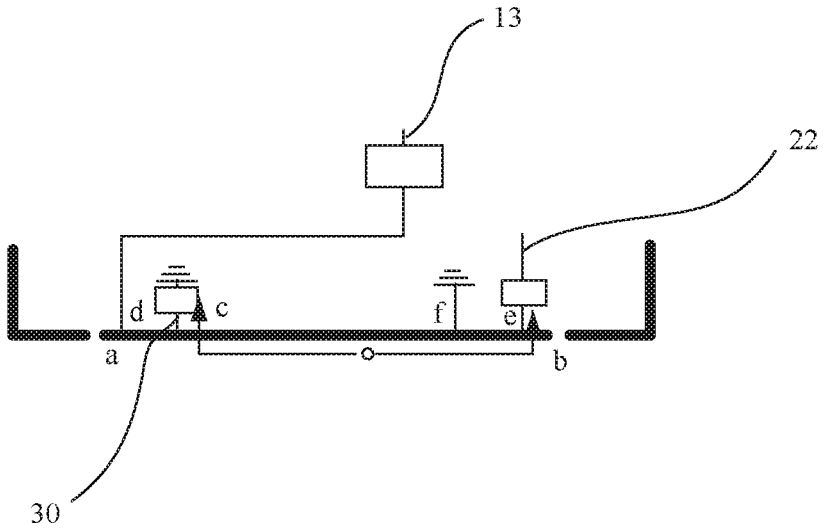
FIG. 13 is a schematic current diagram of a resonance 5 excited by a medium-high frequency antenna shown in FIG. 9.

To understand an operating principle of the medium-high frequency antenna 20 provided in this embodiment, refer to FIG. 10. FIG. 10 is a schematic diagram of resonances excited according to the antenna structure shown in FIG. 9. The medium-high frequency antenna 20 provided in this embodiment may excite six resonances: a resonance 1, a resonance 2, a resonance 3, a resonance 4, a resonance 5, and a resonance 6. The resonance 3, the resonance 4, and the resonance 6 are original resonances, and the resonance 1, the resonance 2, and the resonance 5 are newly excited resonances. Referring to FIG. 11 to FIG. 13, a circle represents a current maximum. Starting from the circle, a current gradually decreases in a direction indicated by an arrow. FIG. 11 is a schematic diagram of a current when the resonance 1 is generated. It can be learned from FIG. 11 that the medium-high frequency antenna 20 excites the resonance 1 by using the conductive wire 16, and a part from the first end a of the second frame 12 to the connection point of the second ground cable 15 and the second frame 12 in the low frequency radiator. FIG. 12 is a schematic diagram of a current when the resonance 2 is generated. The resonance 2 is a new resonance excited by the medium-high frequency antenna 20 by using a part from the first end a of the second frame 12 to the connection point f of the second ground cable 15 and the second frame 12. FIG. 13 is a schematic diagram of a current when the resonance 5 is generated. The resonance 5 is a new resonance excited by the medium-high frequency antenna 20 by using a part from the second connection point c of the first ground cable 30 and the second frame 12 to the first connection point e of the medium-high frequency feeder 22 and the second frame 12, where the part is on the second frame 12 of the low frequency radiator.

FIG. 14 shows another structure of the medium-high frequency antenna 20 provided in this embodiment. A difference between FIG. 9 and FIG. 14 lies in that the medium-high frequency feeder 22 is disposed on the third frame 21, and others in the structure are the same as those in the structure shown in FIG. 9. Details are not described herein again.

Figure 15:
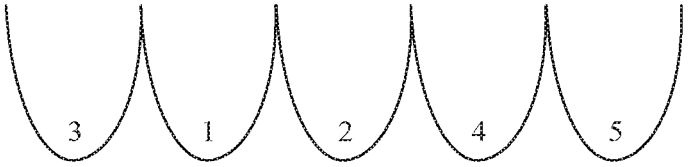
FIG. 15 is a schematic diagram of resonances excited by an antenna shown in FIG. 14.
Figure 16:
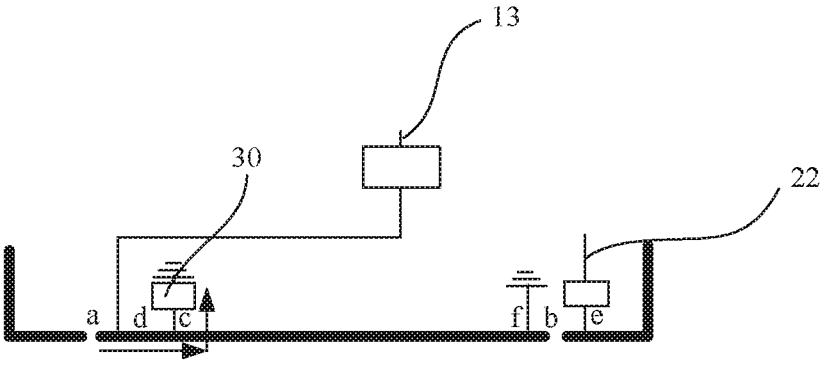
FIG. 16 is a schematic current diagram of a resonance 1 excited by a medium-high frequency antenna shown in FIG. 14.
Figure 17:
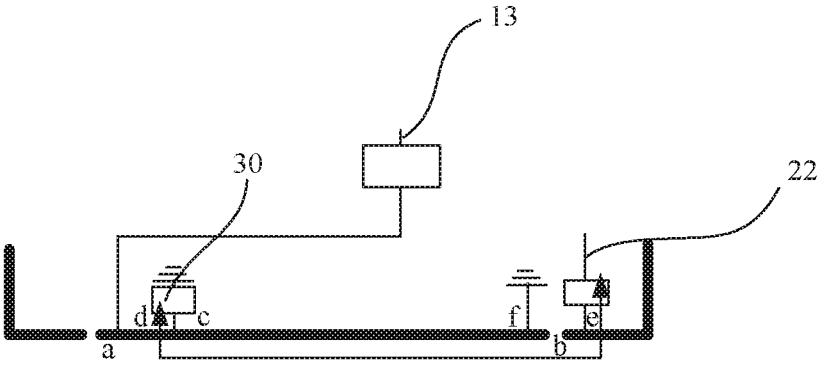
FIG. 17 is a schematic current diagram of a resonance 2 excited by a medium-high frequency antenna shown in FIG. 14.

To facilitate understanding of a frequency band of the medium-high frequency antenna 20 shown in FIG. 14, simulation is performed on the medium-high frequency antenna 20 shown in FIG. 14. FIG. 15 is a schematic diagram of resonances obtained through simulation. The resonances excited by the antenna include a resonance 1, a resonance 2, a resonance 3, a resonance 4, and a resonance 5. The resonance 3 and the resonance 4 are newly excited by the medium-high frequency antenna 20 shown in FIG. 14 in this embodiment. Referring to FIG. 16 and FIG. 17, first referring to FIG. 16, it can be learned from FIG. 16 that, the resonance 3 is a new resonance excited by the medium-high frequency antenna 20 by using a part from the first end a of the second frame 12 to the second connection point c of the first ground cable 30 and the second frame 12. A direction to which an arrow points is a direction in which a current gradually decreases. Referring to FIG. 17, it can be learned from FIG. 17 that the resonance 4 is a new resonance excited by the medium-high frequency antenna 20 by using a part from the second connection point c of the first ground cable 30 and the second frame 12 to the first connection point e of the medium-high frequency feeder 22 and the third frame 13. The part is located on the second frame 12 of the low frequency radiator. A direction to which an arrow points is a direction in which a current gradually decreases.

It can be learned from the foregoing embodiment that, in this embodiment, the first ground cable 30 is added, and the adjustable component 40 is disposed on the first ground cable 30 to adjust a conduction status of the first ground cable 30. When the first ground cable 30 is conducted, the medium-high frequency feeder 22 excites the original resonance, and further excites a new resonance by using the low frequency radiator corresponding to the low frequency feeder 13, so that a bandwidth of a medium-high frequency is increased, thereby improving antenna performance.

An embodiment of the present invention further provides a mobile terminal, and the mobile terminal includes the antenna according to any one of the foregoing implementations. The mobile terminal may be a common mobile terminal such as a mobile phone, a tablet computer, or a laptop computer. In addition, the mobile terminal has a metal frame. As described above, the metal frame is slotted into at least three parts that are electrically isolated from each other: a first frame 11, a second frame 12, and a third frame 21. The first frame 11, the second frame 12, and the third frame 21 are used as a radiator of the antenna. In addition, other structures of the antenna, such as a low frequency feeder 13, a medium-high frequency feeder 22, and a first ground cable 30, are all disposed inside the mobile terminal. In the antenna, the first ground cable 30 is added, and an adjustable component 40 is disposed on the first ground cable 30 to adjust a conduction status of the first ground cable 30. When the first ground cable 30 is conducted, the medium-high frequency feeder 22 excites an original resonance, and further excites a new resonance by using a low frequency radiator corresponding to the low frequency feeder 13, so that a bandwidth of a medium-high frequency is increased, thereby improving antenna performance.

The terms used in the embodiments of the present invention are merely for the purpose of illustrating specific embodiments, and are not intended to limit the present invention. The terms "a", "said" and "the" of singular forms used in the embodiments and the appended claims of the present invention are also intended to include plural forms, unless otherwise specified in the context clearly.

It should be noted that a frequency in the embodiments of the present invention may be understood as a resonance frequency. For a person of ordinary skill in the art, a frequency within a range of 7% to 13% of the resonance frequency may be understood as an operating bandwidth of an antenna. For example, if a resonance frequency of an antenna is 1800 MHz, and an operating bandwidth is 10% of the resonance frequency, an operating range of the antenna is 1620 MHz to 1980 MHz. In addition, a person skilled in the art may understand that, that the antenna works on a same resonance frequency when the adjustable component is conducted and not conducted means that modes of the first resonance frequency are essentially the same when the adjustable component is conducted and not conducted. For example, current distribution and frequencies in conducted and non-conducted states are basically the same. Otherwise, that a new resonance frequency is generated when the adjustable component is conducted means that modes of the resonance frequency, including current distribution, a frequency, and the like, are different from modes of a resonance frequency generated when the adjustable component is not conducted.

It should be further understood that, in the embodiments of the present invention, unless otherwise specified, "greater than" should be understood as including "greater than or equal to", "less than" should be understood as including "less than or equal to", and "above", "below", and "between" should all be understood as including a number itself.

It should be noted that, in the embodiments of the present invention, unless otherwise specified, a number interval should be understood as including a beginning number and an end number, for example, 700 MHz-960 MHz includes 700 MHz and 960 MHz and all frequencies in their intervals, and 800 MHz to 2100 MHz includes 800 MHz and 2100 MHz and all frequencies in their intervals.

It should be noted that, in the embodiments of the present invention, "ground" may be replaced with words such as "antenna grounding part", "antenna ground", and "ground plane", and they are all used to indicate a basically same meaning. The antenna grounding part is connected to a ground cable of a radio frequency transceiver circuit, and the antenna grounding part has a size larger than an operating wavelength of the antenna.

Optionally, the antenna grounding part may be mainly disposed on a surface of a printed circuit board of the communications device. An electrical connection component such as a spring, a screw, a spring plate, conductive fabric, conductive foam, or conductive adhesive is further disposed on the printed circuit board, and is configured to establish a connection between a radio frequency circuit and the antenna, or configured to establish a connection between the antenna grounding part and the antenna. In addition, air, plastic, ceramic, or another dielectric material may be filled between the antenna and the antenna grounding part.

It should be noted that, in the embodiments of the present invention, that A and B are "electrically connected" means that a definitive physical association is established through an electric signal passing through A and an electric signal passing through B, including a direct connection of A and B by using a wire or a spring plate, an indirect connection by using another component C, and an association established, through electromagnetic induction, between electrical signals passing through A and B.

It should be noted that the capacitor and the inductor in the foregoing embodiments may be a lumped capacitor and a lumped inductor, or may be a capacitor and an inductor, or may be a distributed capacitor and a distributed inductor. This is not limited in the embodiments of the present invention.

It should be noted that when ordinal numbers such as "first", "second" and "third" in the embodiments of the present invention are only used for distinguishing unless the ordinal numbers definitely represent a sequence according to a context.

In the foregoing embodiments, the description of each embodiment has respective focuses. For a part that is not described in detail in an embodiment, refer to related descriptions in other embodiments.

The foregoing descriptions are merely specific embodiments of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. An antenna of a mobile terminal, comprising:
a radiator comprising:
a first part;
a second part separated from the first part by a first gap, wherein a first end of the second part is proximate to the first part, and wherein the second part comprises a second end; and
a third part separated from the second part by a second gap, wherein the first part and the third part are disposed on two sides of the second part, and wherein the third part is proximate to the second end;
a medium-high frequency feeder electrically coupled to the radiator at a first coupling point;
a low frequency feeder electrically coupled to the radiator; and
a first ground cable electrically coupled to the radiator at a second coupling point, wherein an adjustable component for controlling conduction of the first ground cable is disposed on the first ground cable,
wherein the antenna is configured to:
operate on a first resonance frequency and not to operate on a second resonance frequency when the adjustable component is not conducting, wherein a length from the second coupling point to an end that is in the first end and the second end and that is furthest from the first coupling point is a quarter of a wavelength corresponding to the second resonance frequency; and
operate on the first resonance frequency and the second resonance frequency when the adjustable component is conducting.

2. The antenna of claim 1, wherein the first resonance frequency is in a first closed interval from 700 megahertz (MHz) to 960 MHz, and wherein the second resonance frequency is in a second closed interval from 1700 MHz to 2700 MHZ.

3. The antenna of claim 1, wherein the antenna is further configured to operate on a third resonance frequency when the adjustable component is not conducting, wherein the third resonance frequency is in a third closed interval from 1700 megahertz (MHz) to 2700 MHz, and wherein the third resonance frequency is not equal to the second resonance frequency.

4. The antenna of claim 1, wherein the first coupling point is located at the second part.

5. The antenna of claim 4, wherein the low frequency feeder is coupled to the radiator at a third coupling point, and wherein a length from the third coupling point to the first end is greater than a length from the first coupling point to the first end.

6. The antenna of claim 1, wherein the first coupling point is located at the third part.

7. The antenna of claim 1, wherein the antenna further comprises a second ground cable electrically coupled to the second part, wherein the low frequency feeder is electrically coupled to the first end using a bent conductive wire, and wherein the low frequency feeder, the bent conductive wire, the second part, and the second ground cable are configured to form a loop.

8. The antenna of claim 1, wherein the adjustable component is a switch, a low-cut high-pass filter, or an adjustable capacitor.

9. The antenna of claim 1, wherein a low frequency signal isolator is disposed on the medium-high frequency feeder, and wherein a high frequency signal isolator is disposed on the low frequency feeder.

10. The antenna of claim 1, wherein the second coupling point is located on a first side of a universal serial bus (USB) port of the mobile terminal, and wherein the first coupling point is located on a second side of the USB port.

11. The antenna of claim 1, wherein the first part, the second part, and the third part are configured to use a metal frame of the mobile terminal.

12. A mobile terminal, comprising an antenna, wherein the antenna comprises:
a radiator comprising:
a first part;
a second part separated from the first part by a first gap, wherein a first end of the second part is proximate to the first part, and wherein the second part comprises a second end; and
a third part separated from the second part by a second gap, wherein the first part and the third part are disposed on two sides of the second part, and wherein the third part is proximate to the second end;
a medium-high frequency feeder electrically coupled to the radiator at a first coupling point;
a low frequency feeder electrically coupled to the radiator; and
a first ground cable electrically coupled to the radiator at a second coupling point, wherein an adjustable component for controlling conduction of the first ground cable is disposed on the first ground cable,
wherein the antenna is configured to:
operate on a first resonance frequency and not to operate on a second resonance frequency when the adjustable component is not conducting, wherein a length from the second coupling point to an end that is in the first end and the second end and that is furthest from the first coupling point is a quarter of a wavelength corresponding to the second resonance frequency; and
operate on the first resonance frequency and the second resonance frequency when the adjustable component is conducting.

13. The mobile terminal of claim 12, wherein the first resonance frequency is in a first closed interval from 700 megahertz (MHz) to 960 MHz; and Wherein the second resonance frequency is in a second closed interval from 1700 Wiz to 2700 MHz.

14. The mobile terminal of claim 12, wherein the antenna is further configured to operate on a third resonance frequency when the adjustable component is not conducting, wherein the third resonance frequency is in a third closed interval from 1700 megahertz (MHz) to 2700 MHz, and wherein the third resonance frequency is not equal to the second resonance frequency.

15. The mobile terminal of claim 12, wherein the first coupling point is located at the third part.

16. The mobile terminal of claim 12, Wherein the antenna further comprises a second ground cable, wherein the second ground cable is electrically coupled to the second part, wherein the low frequency feeder is electrically coupled to the first end using a bent conductive wire, and wherein the low frequency feeder, the bent conductive wire, the second part, and the second ground cable are configured to form a loop.

17. The mobile terminal of claim 12, wherein the adjustable component is a switch, a low-cut high-pass filter, or an adjustable capacitor.

18. The mobile terminal of claim 12, wherein a low frequency signal isolator is disposed on the medium-high frequency feeder, and wherein a high frequency signal isolator is disposed on the low frequency feeder.

19. The mobile terminal of claim 12, wherein the second coupling point is located on a first side of a universal serial bus (USB) port of the mobile terminal, and wherein the first coupling point is located on a second side of the USB port.

20. The mobile terminal of claim 12, wherein the first part, the second part, and the third part are configured to use a metal frame of the mobile terminal.

* * * * *